United States Patent [19]

Nickels, Jr. et al.

[11] Patent Number: 4,552,352

[45] Date of Patent: Nov. 12, 1985

[54] TOP LOADING SHEET FEED APPARATUS FOR PRINTER OR THE LIKE

[75] Inventors: Richard C. Nickels, Jr., Reisterstown; Gerald S. Stevens, Jr., Forest Hill, both of Md.

[73] Assignee: General Instrument Corp., New York, N.Y.

[21] Appl. No.: 482,872

[22] Filed: Apr. 7, 1983

[51] Int. Cl.[4] ..... B65H 13/64

[52] U.S. Cl. ..... 271/10; 271/117; 271/121; 271/126; 271/157; 271/160; 271/273

[58] Field of Search ..... 271/117, 126, 157, 160, 271/167, 118, 10, 121, 273, 274

[56] References Cited

U.S. PATENT DOCUMENTS

| | | | |
|---|---|---|---|
| 3,790,161 | 2/1974 | Ericsson | 271/117 |
| 4,023,792 | 5/1977 | Punnett | 271/118 X |
| 4,286,908 | 9/1981 | Pfaffle | 271/160 X |
| 4,363,477 | 12/1982 | Miyashita | 271/117 X |
| 4,390,175 | 6/1983 | Takahashi | 271/126 X |

*Primary Examiner*—Richard A. Schacher
*Attorney, Agent, or Firm*—James & Franklin

[57] ABSTRACT

The stack of sheets is urged towards a rotatable removal roller located at the top of the magazine. The roller is mounted on a frame which is pivoted relative to the magazine to provide access to the stack for reloading. Pivoting of the frame automatically actuates a spring-loaded rachet-type mechanism which prevents movement of the stack towards the open top end of the magazine, without interfering with the placement of additional sheets onto the stack.

43 Claims, 7 Drawing Figures

TOP LOADING SHEET FEED APPARATUS FOR PRINTER OR THE LIKE

The present invention relates to mechanisms for sequentially feeding sheets of paper or thin cardboard and, more particularly, to a top loading sheet feed apparatus primarily designed for use in ticket or card printing, reading, or sorting equipment.

Many different types of equipment employ apparatus which retains a plurality of paper or cardboard sheets and feeds the sheets, one at a time, in sequence, to a location for processing of one type or another. The word "sheet," as used herein, is to be construed in a broad sense to encompass any generally planar member which may be situated in a stack or pile and, thereafter, removed therefrom, such as a ticket, card, label, or the like. The sheet feed apparatus of the present invention may, thus, be utilized in printers, readers, and/or sorters, duplicators, or similar types of equipment.

Conventional sheet feed mechanisms include a sheet retaining magazine in which a stack of sheets is stored. Frictional engagement is used to remove the sheets from a stack one at a time. A movable removal member is situated adjacent the first sheet in the stack and the stack is urged into frictional engagement with the member. When the member is moved, the first engaged sheet in the stack is displaced relative to the stack, usually through a gate-type mechanism with an opening wide enough to permit passage of only a single sheet at a time. The removed sheet is then transferred to a position remote from the stack to be operated on by a printer, reader, or the like.

Feed mechanisms utilizing frictional engagement devices are normally structured such that sheets are removed, one at a time, either from the bottom of the stack or from the top of the stack. Mechanisms where the sheets are removed from the bottom of the stack, that is, the frictional engaging member is located below the stack, have the advantage of permitting easy access for loading of the sheet retention magazine from the top. This is possible because the frictional engaging member and the frame structure to which same is mounted, do not obstruct the top of the magazine. However, this type of mechanism suffers from a serious disadvantage in that it relies on the force of gravity to insure frictional engagement between the frictional engagement member and the bottommost sheet on the stack. That is, the weight of the stack bears down on the upper surface of the bottom sheet on the stack, such that the lower surface of the bottom sheet is urged into frictional engagement with the removal member.

In such a situation. the removal member can operate only if the driving force applied thereto, and the frictional engagement between the member and the lower surface of the bottom sheet, are greater than the frictional forces between the upper surface of the bottom sheet and the remainder of the stack. If the frictional forces between the upper surface of the bottom sheet and the remainder of the stack cannot be overcome by action of the member, the bottom sheet in the stack cannot be removed. As the number of sheets in the stack increases, so does the gravitational force exerted by the stack on the upper surface of the bottom sheet. As the gravitational force increases, so does the force required to remove the bottom sheet in the stack. Thus. there is a practical limitation on the size of the stack and, accordingly, the number of sheets which can be situated on the stack at any one time. This limitation becomes particularly acute where sheets are rapidly removed from the stack. In such situations, frequent replenishing of the sheets in the stack is required, resulting in an unacceptable amount of down time for the equipment.

In order to overcome this disadvantage, some sheet feed mechanisms have been designed such that sheets are removed in sequence from the top of the stack, instead of the bottom. In this instance, the removal member and the frame which carries it must be located at the top of stack retaining magazine, adjacent the top of the stack. Frictional engagement between the top sheet on the stack and the removal member must be maintained by spring-loading the stack upwardly within the magazine, towards the removal member. This eliminates the problems associated with the gravitational forces exerted by a large stack, and thus permits larger numbers of sheets to be situated on the stack at one time. However, this type of mechanism normally must be loaded from either the bottom or the side of the magazine because the removal member and the frame structure to which same is mounted are located at the top of the magazine and, hence, obstruct access to the top of the stack.

Certain types of equipment, such as ticket printers or readers, and card processors, are used in locations where access to the side or bottom of the stack may be restricted or prevented. Such mechanisms require top loading magazines. In order to provide a top loadable magazine and, at the same time, design the mechanism for removal of the sheets from the top of the stack, the removal member and associated apparatus may be mounted on a frame which is movable with respect to the magazine, to a position remote therefrom, to permit access to the top of the magazine for reloading. However, moving the removal member to a position remote from the top of the stack results in a serious problem.

As indicated above, when the removal member is located above the stack, it is necessary to urge the stack upwardly towards the removal member to insure sufficient frictional engagement between the top sheet and the member. This is accomplished by a relatively strong spring situated below a platform upon which the stack rests. The spring urges the platform towards the removal member. This spring must be strong enough to overcome the gravitational forces exerted by a large stack. Movement of the removal member to a position remote from the top of the stack places the member in a position wherein it no longer holds the stack down against the action of the spring. Unless the stack is manually retained, when the magazine is opened for loading, the spring will abruptly push the remaining sheets in the stack upwards such that the sheets will be pushed out of the stack retaining magazine. This will cause the sheets to be thrown around the machine and the surrounding area, a result which obviously must be avoided.

The operator can prevent this from happening if he or she can position his/her hand on the top of the stack and hold same down as the removal member is moved to the remote location. If this is accomplished, however, the operator only has one free hand to load additional sheets onto the stack. Moreover, the stack must be held down by the operator as the removal member is repositioned—a manipulation which is difficult to perform without prematurely releasing the stack or accidentally injuring the operator's hand as the mechanism is closed.

In order to eliminate this problem, the present invention employs a rachet-type mechanism which automatically engages and prevents upward movement of the spring-loaded platform upon which the stack rests, when the removal member is moved to a position remote from the top of the stack. By preventing upward movement of the stack, the sheets cannot be pushed outwardly from the magazine. The rachet-type mechanism must, however, operate in a manner which does not prevent downward movement of the stack, such that additional sheets can be situated on the stack without interference.

It is, therefore, a prime object of the present invention to provide top loading sheet feed apparatus for a printer or the like wherein stack loading can be quickly, easily, and safely performed.

It is another object of the present invention to provide a top loading sheet feed apparatus for a printer or the like which permits a printer or similar apparatus to be used in locations where access to the side or the bottom of the stack retaining magazine is restricted or prevented.

It is another object of the present invention to provide a top loading sheet feed apparatus for a printer or the like wherein the stack urging means is automatically immobilized in the direction towards the opened end of the magazine when the stack is accessed for loading.

It is another object of the present invention to provide a top loading sheet feed apparatus for a printer or the like wherein loading of additional sheets onto the stack can be accomplished without interference from the mechanism which immobilizes the stack urging means.

It is another object of the present invention to provide a top loading sheet feed apparatus for a printer or the like wherein a rachet-type mechanism, utilized to prevent movement of the stack in the direction towards the open end of the magazine, is actuated automatically upon opening of the magazine.

It is another object of the present invention to provide a top loading sheet feed apparatus for a printer or the like which has the capacity for retaining a large number of sheets.

It is another object of the present invention to provide a top loading sheet feed apparatus for a printer or the like which consists of a limited number of simple and inexpensive parts which function together reliably and require a minimum of maintenance.

In accordance with the present invention, sheet feed apparatus is provided including means for retaining a stack of sheets, the retaining means having an end. Means, normally situated to cooperate with the stack, at said end, are provided for removing sheets from the stack, in sequence. Means are provided for urging the stack towards said end. The removing means is movable relative to the stack, towards a position remote from said end. Means are provided, responsive to the movement of the removing means, for preventing movement of the stack towards said end.

The movement preventing means, when actuated, prevents the urging means from urging the stack towards the open loading end of the sheet retaining means. However, the movement preventing means, when actuated, cooperates with the stack urging means to permit movement of the stack urging means in a direction away from said end. Thus, additional sheets can be easily loaded onto the stack through the open loading end of the magazine, without the stack being pushed out of the magazine.

The stack urging means preferably comprises a spring-loaded member in the form of a platform upon which the stack rests. The movement preventing means comprises means for operably engaging the platform. The movement preventing means comprises actuation means responsive to the position of the removing means.

The platform engaging means comprises a rachet-type member, movable between a first position (remote from the platform) and a second position (in engagement with the platform). Means are provided for urging the rachet-type member towards the second position. The rachet-type member cooperates with the sheet removing means and is moved to the first position, against the action of the member urging means, when the removal means is situated at the end of the magazine to cooperate with the stack.

The platform includes a protrusion and the rachet-type member comprises protrusion engaging means. The protrusion engaging means comprises a set of spaced protrusion engaging teeth, at least one of which is situated to intersect the path of movement of the protrusion, when the rachet-type member is in the second position. The protrusion engaging means also comprises means cooperating with the protrusion, as the platform is moved against the force exerted by the stack urging means and, thus, away from the loading end during loading, for moving the member to a position wherein the protrusion engaging means is out of the path of movement of the protrusion, such that the protrusion can pass by the protrusion engaging means as additional sheets are placed on the stack. The protrusion engaging means comprises a part having a protrusion engaging surface and a camming surface.

Means are provided for limiting the movement of the platform. The protrusion preferably comprises a portion of the movement limiting means.

Means are also provided for sensing a predetermined position of the stack to indicate when reloading of the stack is required. The sensing means preferably comprises photosensitive signal generating means.

The stack retaining means preferably comprises a magazine including a wall, along which the platform moves. An opening is provided in the wall. The platform comprises a protrusion adapted to extend through the opening and into alignment with the platform engaging means. Preferably, the platform engaging means is movably mounted on the wall.

The apparatus preferably further comprises a frame having first and second relatively movable portions. The means for retaining the stack of sheets is located on one of the frame portions and the means for removing sheets from the stack is located on the other frame portion. The frame portions are normally in a first relative position, wherein the removing means is adjacent the stack. However, during loading, the frame portions are moved to a second relative position, such that the removal means is remote from the stack to provide access to the top of the magazine. The movement preventing means is responsive to the relative movement of the frame portions from the first relative position to the second relative position such that it is actuated only when the frame portions are in the second relative position. Preferably, the frame portion which carries the removal means is pivotally interconnected with the frame portion which comprises the stack retaining means.

To these and to such other objects which may hereinafter appear, the present invention relates to a top loading sheet feed apparatus for a printer or the like as described in the following specification and recited in the annexed claims, taken together with the accompanying drawings, wherein like numerals refer to like parts and in which:

Figure 2:
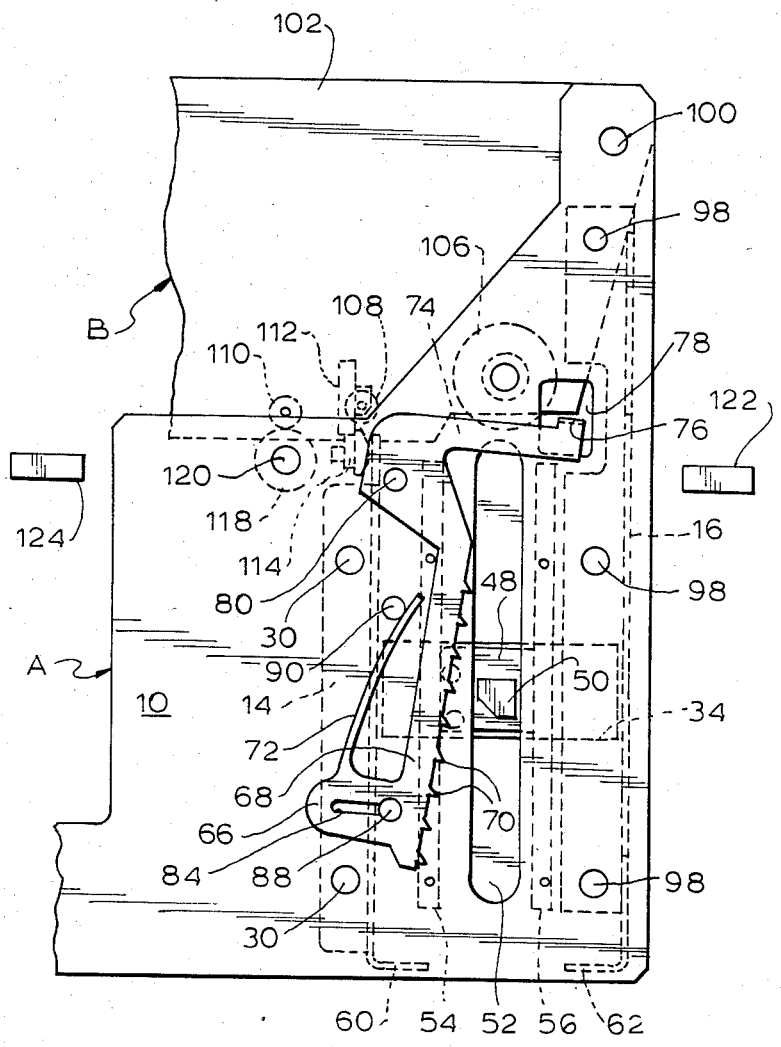
FIG. 2 is an elevational view of one side of the magazine illustrated in FIG. 1, shown in conjunction with the frame which carries the stack removal member, the latter being shown in its "feed" or closed position.
Figure 3:
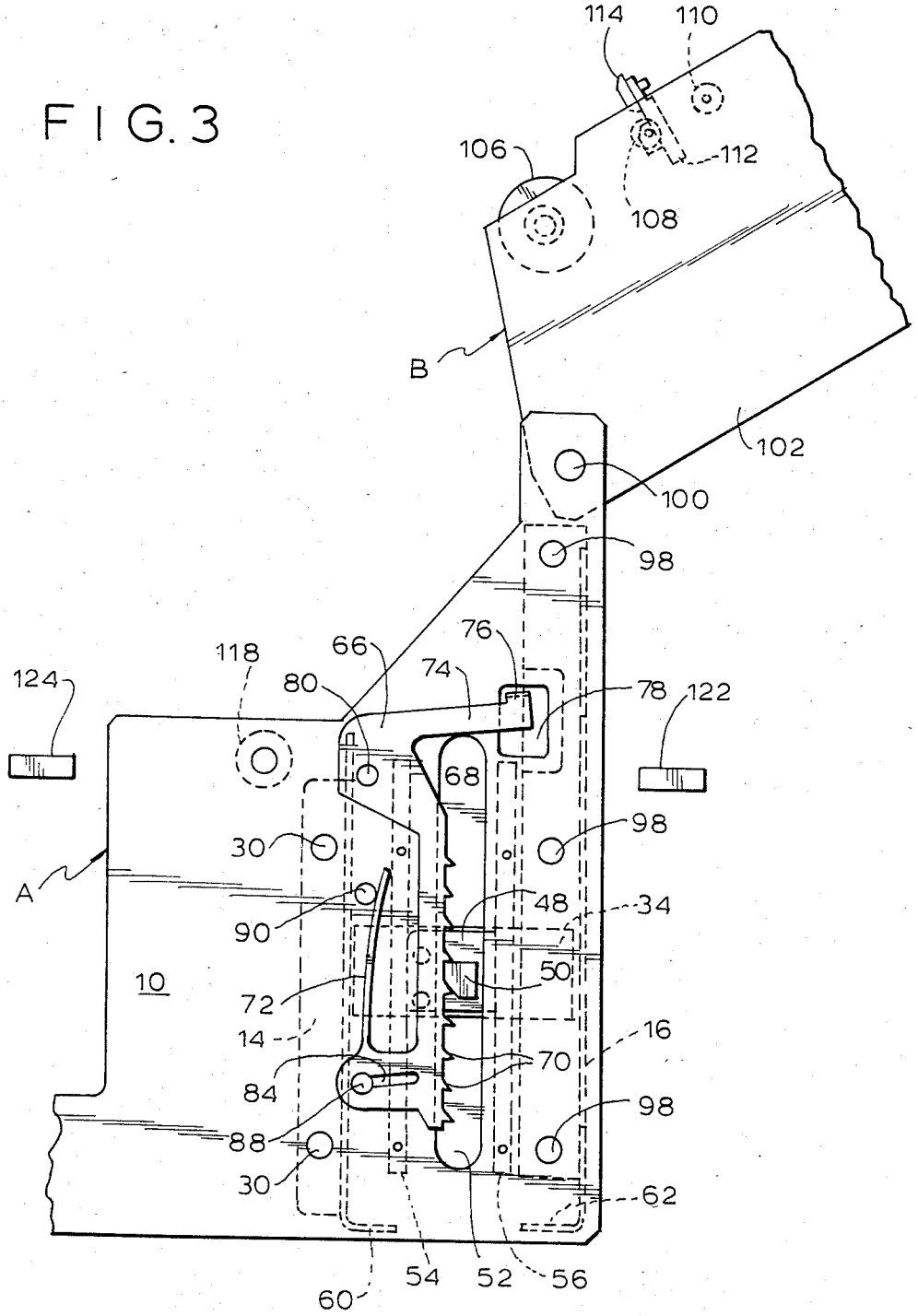
FIG. 3 is a side elevational view similar to that shown in FIG. 2, but illustrating the frame which carries the sheet removal member in its loading or open position.
Figure 4:
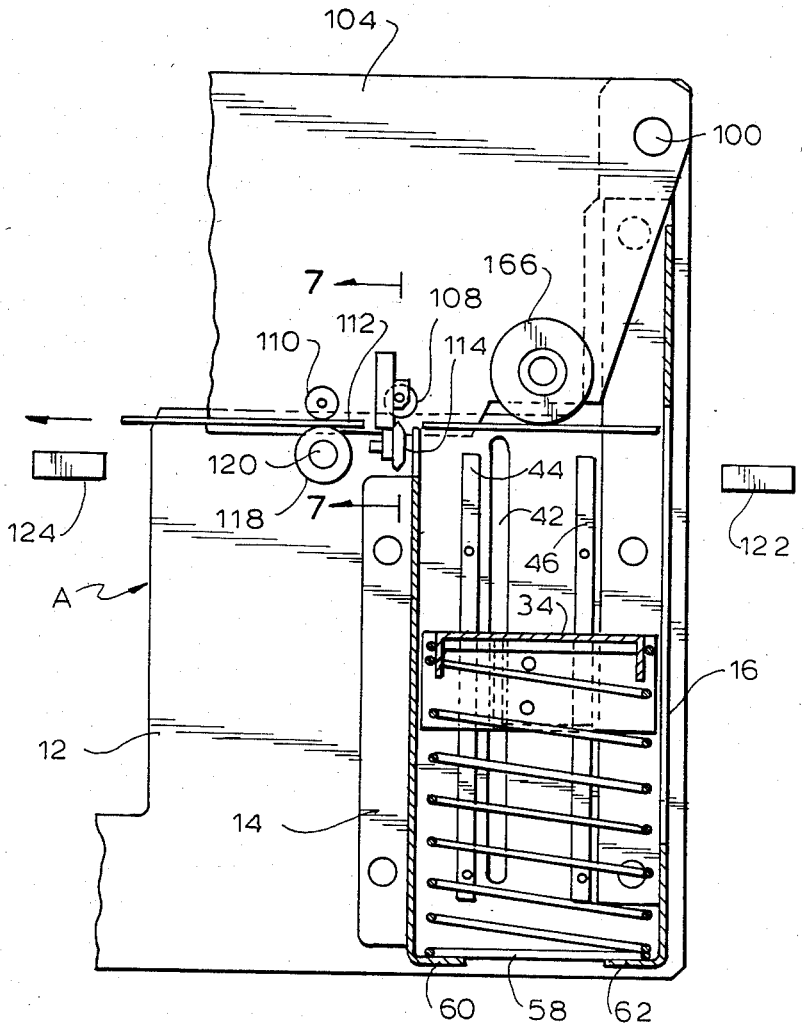
FIG. 4 is a side cross-sectional view of the present invention showing same in the feed or closed position.
Figure 5:
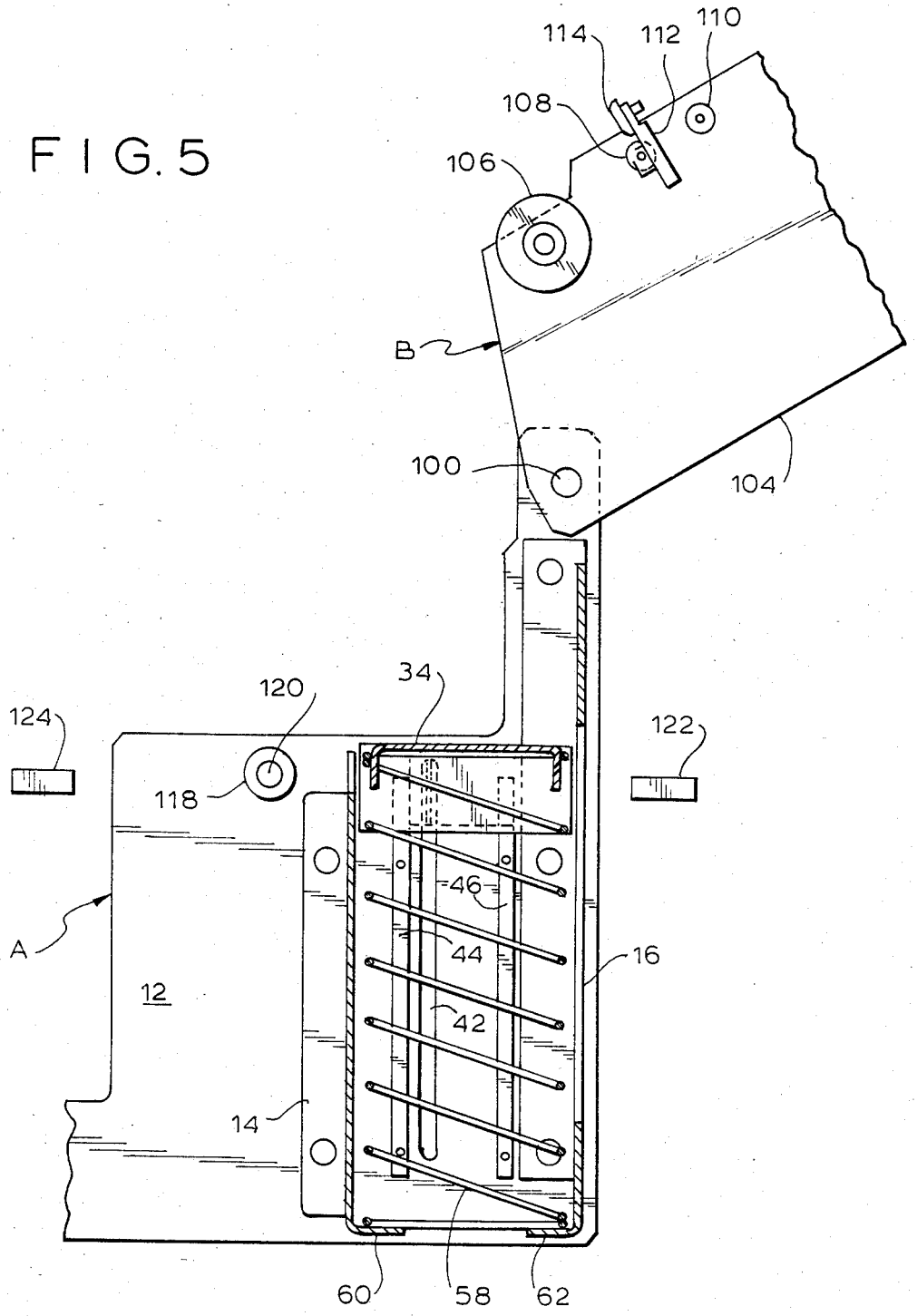
FIG. 5 is a side cross-sectional view of the present invention showing same in the loading or open position.

The present invention includes first and second frame members, generally designated A and B, respectively. Frame member A comprises the stack retaining means in the form of a box-like magazine within which a stack of sheets is situated. Frame member B includes a structure upon which the sheet removal means is mounted. As described in detail below, frame members A and B are movable relative to each other, between a feed or closed position, as illustrated in FIGS. 2 and 4, and a loading or open position, as illustrated in FIGS. 3 and 5. Although the drawings illustrate frame member A as being stationary and frame member B as being movable with respect thereto, it is to be understood that frame member B could be stationary and frame member A movable with respect thereto. Relative movement of the frame members A and B is necessary to permit access to the magazine for loading the stack.

Figure 1:
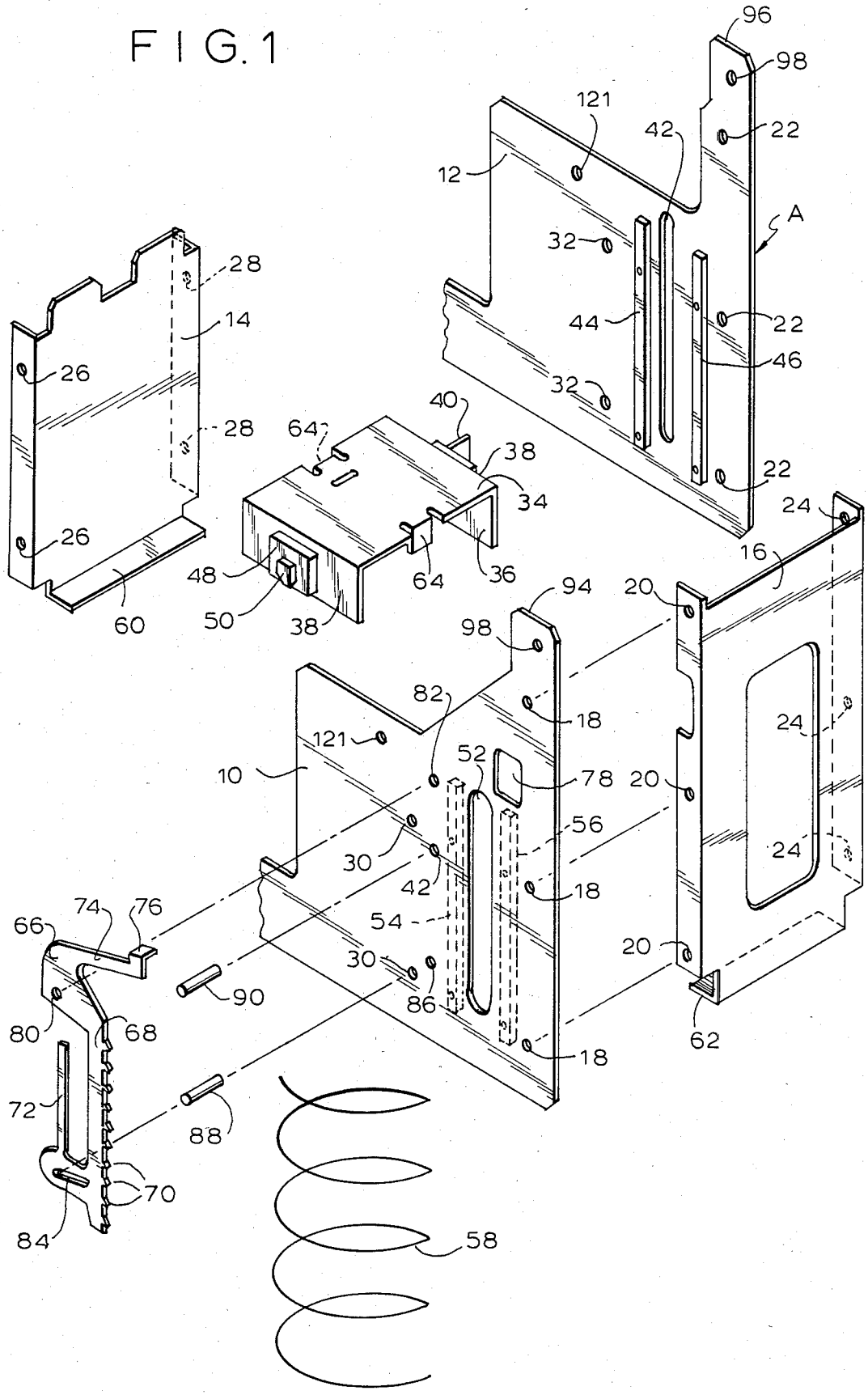
FIG. 1 is an exploded isometric view of the stack retaining magazine of the present invention, showing the rachet-type mechanism which prevents upward movement of the stack during loading.

As illustrated in FIG. 1, frame member A includes a stack retaining magazine having a generally box-like configuration, defined by a first side wall 10, a second side wall 12, a front wall 14, and a rear wall 16. Side wall 10 is provided with three openings 18 which align with openings 20 in rear wall 16 such that the side wall 10 can be joined to rear wall 16 by screws, rivets, or the like. Similarly, side wall 12 is provided with openings 22 which align with openings 24 in rear wall 16, such that side wall 12 can be joined to rear wall 16. Front wall 14 is provided with openings 26, 28 which align with openings 30 in side wall 10 and openings 32 in side wall 12, respectively, such that front wall 14 can be joined to side walls 10 and 12.

Situated within the magazine formed by side walls 10, 12, front wall 14, and rear wall 16 is the stack urging means which takes the form of a spring-loaded platform 34, upon which a stack of sheets is placed. Platform 34 is movable in a vertical direction within the magazine. Platform 34 has a generally "U"-shape, with sides 36, 38 extending downwardly from the horizontal portion of the platform. Mounted on the exterior of side 36 is a block 38 from which a protrusion 40 extends outwardly. Protrusion 40 extends through and cooperates with an elongated opening 42 on side wall 12 so as to limit the vertical movement of platform 34. Wall 12 is also provided with a pair of inwardly extending spaced guide elements 44, 46 which are situated on either side of block 38 so as to limit the lateral movement of the platform 34.

Situated on side 38 of platform 34 is a second block 48 from which a second protrusion 50 extends outwardly. Side 10 is provided with an elongated opening 52 through which protrusion 50 extends. Protrusion 50 cooperates with elongated opening 52 to limit the vertical movement of the platform within the magazine. Side 10 is also provided with a pair of inwardly extending spaced guide elements 54, 56 which are situated on either side of block 48 and cooperate with block 48 to limit the lateral movement of platform 34 within the magazine.

A spring 58 is provided to urge platform 34 towards the top of the magazine. Spring 58 is situated between the inwardly extending lips 60 and 62 mounted on the bottom of front wall 14 and rear wall 16, on the one hand, and the bottom of the horizontal portion of platform 34. A pair of downwardly extending members 64 on platform 38 are provided to engage the top of spring 58.

The rachet-type mechanism which cooperates with platform 34 to prevent upward movement of the platform during loading of the stack comprises a member 66 situated on the exterior of wall 10, adjacent opening 52, so as to cooperate with protrusion 50 which extends from platform 34 through opening 52. Member 66 includes a main portion 68 upon which a plurality of spaced teeth 70 are mounted. Each of the teeth 70 includes a protrusion engaging surface, located on the bottom of the tooth and meeting the edge of portion 68 at approximately a right angle, and an inclined camming surface located on the top of the tooth, which meets the edge of portion 68 at an obtuse angle.

A spring, in the form of a resilient elongated element 72, extends from the bottom of member 66, in a substantially vertical direction, and is approximately parallel to, but spaced from, portion 68, in its free state. Member 66 also has an actuation portion 74, including an actuation element 76 which extends in a plane substantially perpendicular to the remainder of member 66 and towards side wall 10. An opening 78 is provided in side wall 10 to receive actuation element 76 therethrough such that element 76 aligns with frame member B.

Member 66 is provided with a circular opening 80 designed to align with opening 82 in side wall 10 to permit member 66 to be rotatably mounted on side wall 10 about this point. The lower portion of member 66 is provided with an elongated arcuate opening or slot 84 into which a protrusion 88 extending from opening 86 is received. The elongation of opening 84 permits member 66 to rotate about point 80 through an arc defined by opening 84. A second protrusion 90 extends from opening 92 in side wall 10 and cooperates with spring element 72 of member 66 so as to spring load member 66 towards a position wherein portion 68 thereof aligns with opening 52 in side wall 10.

Side walls 10 and 12 are provided with upwardly extending spaced parallel top portions 94, 96, respectively, each of which has an opening 98 therein. As best seen in FIGS. 4 and 5, a shaft 100 passes through openings 98 in portions 94, 96. Frame member B is rotatably mounted on shaft 100 so as to mount frame member B on frame member A in a pivotal manner. Frame member B can be pivoted with respect to frame member A from the feed position, as shown in FIGS. 2 and 4 to the loading position, as shown in FIGS. 3 and 5, to provide access to the top of the stack.

Figure 7:
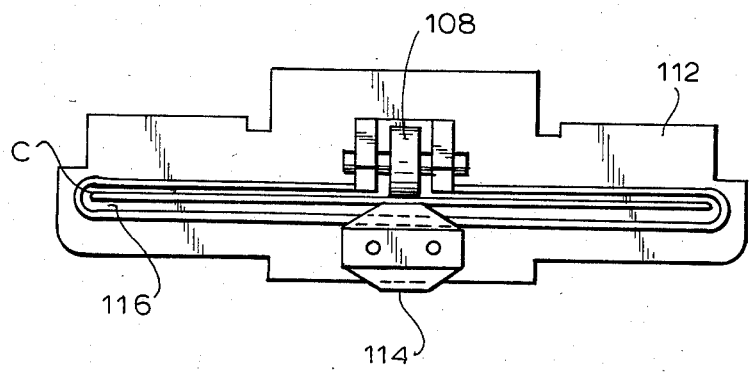
FIG. 7 is a fragmentary sectional view, taken along line 7—7 of FIG. 3, showing the removal member and blade of the present invention.
Figure 6:
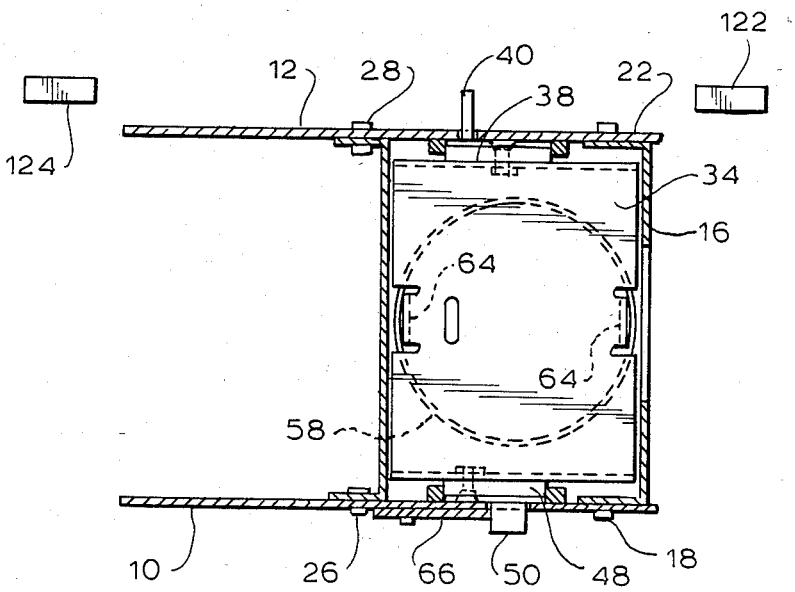
FIG. 6 is a top elevational view of the present invention.

Frame member B consists of a pair of spaced parallel walls 102, 104 between which a motor-driven removal roller 106, a throat roller 108, and a pick-up roller 110 are mounted. When frame member B is in the closed position, removal roller 106 is situated at the top of the magazine to frictionally engage the upper surface of the top sheet on the stack, approximately at the middle portion thereof. A support 112 is located forward (to the left, as shown in the drawings) of removal roller 106. Throat roller 108 is mounted on a support member 112, which also carries a blade 114. Roller 108 and the top of blade 114 are spaced apart slightly to function as a gate such that only a single sheet can pass therebetween. Within support member 112 is an elongated slot 116 (best seen in FIG. 7) wide enough to permit the passage of a sheet therethrough. Forward of support 112 is situated a first pick-up roller 110 which cooperates with a second pick-up roller 118, the latter being rotatably mounted on a shaft 120 passing through openings 121 in side walls 10 and 12.

In the feed position of frame members A and B, as illustrated in FIGS. 2 and 4, spring 58 urges platform 34, upon which the stack of sheets rests, towards the top of the magazine such that the upper surface of the top sheet is in frictional engagement with removal roller 106. When removal roller 106 is rotated, the top sheet is moved (to the left, as seen in the drawings) with respect to the remainder of the stack, such that the leading edge thereof passes between throat roller 108 and blade 104 and, thereafter, through slot 116 in support 112. Further rotation of the removal roller 106 causes the sheet to be situated between pick-up rollers 110 and 118 and, thereafter, driven to another part of the machine to be printed, read, or the like. The distance between throat roller 108 and the top edge of blade 114 is set such that only a single sheet can pass between same at any one time, thus preventing removal of more than one sheet from the magazine.

As sheets are removed from the magazine in sequence, platform 34 will gradually move upwardly within the magazine until protrusion 40, which extends through and beyond opening 42 in side wall 12, approaches the top of opening 42 which defines the limit of the upward movement of the platform. At this point, protrusion 40 will interrupt a light beam travelling between a light source 122 and a photo-sensitive detector 124, located adjacent the exterior of side wall 12. Breaking the light beam causes detector 124 to generate a signal which informs the operator, by means of an indicator light or buzzer, that the stack is almost exhausted and that loading of additional sheets is required.

As best seen in FIG. 2, when frame member B is in the feed position with respect to frame member A, rachet-type member 66 is situated in its clockwise-most position, against the urging of spring element 72, such that portion 68 and teeth 70 extending therefrom are remote from protrusion 50 extending from platform 34 and through opening 52 in wall 10. In this position, member 66 does not interfere with the movement of platform 34 in either vertical direction. Member 66 is held in its clockwise-most or unactuated position by the depression of actuation element 76, which extends through wall 10 at opening 78 and is engaged by the bottom edge of frame member B.

When frame member B is pivoted about shaft 100, and thus with respect to frame member A, the loading position, as illustrated in FIGS. 3 and 5, actuation element 76 of member 66 is released by frame member B and spring element 72 cooperates with protrusion 90 to pivot member 66 about point 80 such that protrusion 88 moves to the opposite end of opening 84. This is the counterclockwise-most position of member 66 and, in this position, body portion 68 of member 66 is situated adjacent the path of movement of protrusion 50 and teeth 70, which extend from the edge of body portion 68, intersect the path of movement of protrusion 50, and engage the protrusion.

Once frame member B has been pivoted to the loading position, removal roller 106 no longer is aligned with the stack such that spring 58 would normally urge platform 34 towards the open top of the magazine, causing the remaining sheets to be pushed out of the magazine. However, the engagement of protrusion 50 by one of the teeth 70, extending from member 66, prevents this by preventing platform 34 from moving upwardly.

As best seen in FIG. 3, protrusion 50 has a generally square configuration, except for the bottom left-hand corner which is cut away to form an inclined surface. The distance between the top surface of protrusion 50 and the inclined surface is substantially equal to the distance between teeth 70 on member 66. The upward force of spring 58 on platform 34 causes the top surface of protrusion 50 to engage the bottom horizontal surface of the tooth 70 situated immediately above the protrusion.

As long as member 66 is held in its counterclockwise-most position by the action of spring element 72, platform 34 will be prevented from moving upwardly past the tooth 70 engaging the top surface of protrusion 50. However, downward movement of protrusion 50 and, thus, platform 34, caused by the insertion of additional sheets onto the stack to load the magazine, is not prevented. This is because teeth 70, and particularly the upward facing inclined camming surfaces thereof, cooperate with the similarly inclined surface of protrusion 50 to pivot member 66 against the action of spring element 72 such that protrusion 50 can pass by the teeth and, thus, move downwardly with respect to member 66. When the downward movement of the stack is completed, spring 58 will again urge platform 34 upwardly such that protrusion 50 will be engaged by the tooth 70 immediately above its new position. Member 66 will cooperate with protrusion 50 to prevent upward movement of platform 34 until frame member B has been pivoted back to the feed position, as shown in FIGS. 2 and 4.

When frame member B is pivoted back to the feed position, the bottom edge thereof depresses actuation element 76, causing member 66 to pivot about point 80, against the action of spring element 72, so that it is once again remote from protrusion 50 and no longer obstructs the upward movement thereof. Accordingly, subsequent actuation of removal roller 106 will cause the sheets from the magazine to be fed in sequence from the magazine to other portions of the equipment.

It will now be appreciated that the present invention relates to a top loading sheet feed apparatus for a printer or the like wherein loading of the stack can be quickly, easily, and safely performed from the top of the magazine. This is because the stack urging means is automatically immobilized in the upward direction when the stack is accessed for loading. This permits the apparatus to be situated in locations where access to the side or the bottom of the stack is restricted or prevented. During loading, a rachet-type mechanism automatically prevents movement of the stack towards the open end of the magazine while permitting movement of the stack in the opposite direction such that additional sheets can be loaded. The present invention consists of a limited number of simple and inexpensive parts which function together reliably.

While only a single preferred embodiment of the present invention has been disclosed herein for purposes of illustration, it is obvious that many modifications and variations could be made thereto. It is intended to cover all of these variations and modifications which fall within the scope of the present invention, as defined by the following claims:

We claim:

1. Sheet feed apparatus comprising means for retaining a stack of sheets, said retaining means having an end through which sheets can be loaded onto the stack, means for continuously urging said stack towards said end, means, normally situated in an operational position relative to said end to cooperate with said stack, for removing sheets from said stack in sequence, said removing means being movable relative to said end, between said operational position wherein said stack is maintained within said retaining means by said removing means against the action of said urging means, and a load position remote from said end wherein said stack is no longer maintained within the retaining means by said removing means against the action of said urging means, and means, actuated in response to said movement of said removing means from said operational position toward said load position, for preventing substantial movement of said stack toward said end when said movement preventing means is actuated.

2. The apparatus of claim 1, wherein said movement preventing means permits movement of said stack in a direction away from said end.

3. The apparatus of claim 1, wherein said movement preventing means, when actuated, engages said urging means and prevents same from moving said stack towards said end.

4. The apparatus of claim 1, wherein said stack urging means comprises a spring-loaded means associated with said stack and wherein said movement preventing means comprises means for operably engaging said spring-loaded means.

5. The apparatus of claim 1, wherein said movement preventing means comprises actuation means responsive to the position of said removing means.

6. The apparatus of claim 4, wherein said engaging means comprises a member movable between a first position, remote from said spring-loaded means, and a second position, in engagement with said spring-loaded means.

7. The apparatus of claim 6, further comprising means for urging said member towards said second position.

8. The apparatus of claim 6, wherein said member cooperates with said removing means and is moved to said first position, against the action of said member urging means, when said removal means is situated at said end.

9. The apparatus of claim 6, wherein said spring-loaded means comprises a protrusion and wherein said member comprises protrusion engaging means.

10. The apparatus of claim 9, wherein said protrusion engaging means comprises a set of spaced protrusion engaging teeth, at least one of which is situated to intersect the path of movement of said protrusion when said member is in said second position.

11. The apparatus of claim 6, further comprising means for limiting movement of said spring-loaded means and wherein said protrusion comprises a portion of said movement limiting means.

12. The apparatus of claim 1, further comprising means for sensing a predetermined position of said stack.

13. The apparatus of claim 12, wherein said sensing means comprises photo-sensitive signal generating means.

14. The apparatus of claim 12, wherein said retaining means comprises a wall having a slot, wherein said urging means comprises a protrusion extending through and beyond said slot, said sensing means being situated adjacent said wall to cooperate with said protrusion.

15. The apparatus of claim 14, wherein said wall partially defines a magazine and wherein said sensing means is located proximate the exterior of said wall.

16. The apparatus of claim 14, wherein said sensing means generates a light beam proximate said wall and wherein said protrusion interrupts said light beam when said urging means is in said predetermined position.

17. The apparatus of claim 4, wherein said retaining means comprises a wall which, in part, defines an area in which said stack is situated and along which said spring-loaded means moves, an elongated opening in said wall and wherein said spring-loaded means comprises a protrusion adapted to extend through said opening and into alignment with said engaging means.

18. The apparatus of claim 17, wherein said engaging means is movably mounted on said wall.

19. The apparatus of claim 18, wherein said movement preventing means, when actuated, cooperates with said stack urging means to prevent movement of said stack urging means toward said end.

20. Apparatus for operating on a sheet comprising a frame comprising first and second relatively movable frame members, means located on one of said frame members for retaining a stack of sheets, means located on the other of said frame members situated to cooperate with said stack at one end thereof when said frame members are in a first relative position, for removing sheets from said stack in sequence, operating means for operating on said sheets after same are removed from said stack by said removing means, means associated with said retaining means for continuously urging said stack towards said end, said removing means being movable from a position wherein said stack is maintained within said retaining means by said removing means against the action of said urging means, to a position remote from said stack wherein said stack is no longer maintained by said removing means against the action of said urging means, when said frame members are moved to a second relative position, and means, actuated in response to the relative movement of said frame members, from said first relative position to said second relative position, for preventing substantial movement of said stack towards said end from the position of said stack when said movement preventing means is actuated.

21. The apparatus of claim 20, wherein said movement preventing means, when actuated, permits movement of said stack in a direction away from said end.

22. The apparatus of claim 20, wherein said stack urging means comprises a spring-loaded means associated with said stack and wherein said movement preventing means comprises means for operably engaging said spring-loaded means.

23. The apparatus of claim 20, wherein said movement preventing means comprises actuation means responsive to the relative position of said frame members.

24. The apparatus of claim 23, wherein said actuation means actuates said movement preventing means when said frame members are in said second relative position.

25. The apparatus of claim 20, wherein said frame members are remote from each other in said second relative position.

26. The apparatus of claim 22, wherein said engaging means comprises a member movable between a first position, remote from said spring-loaded means, and a second position, in engagement with said spring-loaded means.

27. The apparatus of claim 26, further comprising means for urging said movable member towards said second position.

28. The apparatus of claim 27, wherein said movable member cooperates with said other frame member and is moved to said first position, against the action of said movable member urging means, when said frame members are in said first relative position.

29. The apparatus of claim 26, wherein said spring-loaded means comprises a protrusion and wherein said movable member comprises protrusion engaging means.

30. The apparatus of claim 29, further comprising means for limiting movement of said spring-loaded means and wherein said protrusion comprises a portion of said movement limiting means.

31. The apparatus of claim 20, further comprising means for sensing a predetermined position of said stack urging means.

32. The apparatus of claim 31, wherein said sensing means comprises photo-sensitive signal generating means.

33. The apparatus of claim 32, wherein said photo-sensitive signal generating means is situated proximate the exterior of said retaining means.

34. The apparatus of claim 33, wherein said retaining means comprises a wall which, in part, defines a magazine in which the stack is located, said wall having a slot and said spring-loaded means comprising a protrusion extending through and beyond said slot, said sensing means cooperating with said protrusion to sense said predetermined position.

35. The apparatus of claim 34, wherein said photo-sensitive signal generating means generates a light beam proximate said wall and wherein said protrusion interrupts said beam at said predetermined position.

36. The apparatus of claim 22, wherein said retaining means comprises a wall which, in part, defines a magazine in which said stack is situated and along which said spring-loaded means moves, an elongated opening in said wall and wherein said spring-loaded means comprises a protrusion adapted to extend through said opening and into alignment with said spring-loaded means engaging means.

37. The apparatus of claim 36, wherein said engaging means is movably mounted on said wall.

38. The apparatus of claim 20, further comprising means for pivotally interconnecting said frame members for movement between said first and second relative positions.

39. The apparatus of claim 20, wherein said one of said frame members prevents access to said end of said retaining means when said frame members are in said first relative position.

40. The apparatus of claim 22, wherein said movement preventing means comprises actuation means responsive to the relative position of said frame members.

41. The apparatus of claim 40, wherein said retaining means comprises a wall which, in part, defines a magazine into which the stack is situated, said wall having an opening and wherein said actuation means extends through said opening into alignment with said other of said frame members.

42. The apparatus of claim 20, further comprising gate means for permitting removal of a single sheet at a time from said stack, said gate means being mounted on said other of said frame members.

43. The apparatus of claim 20, further comprising first and second pick-up rollers. said pick-up rollers being mounted on opposite ones of said frame members and being aligned when said frame members are in said first relative position.

* * * * *